United States Patent [19]

Svoboda et al.

[11] 4,372,574

[45] Feb. 8, 1983

[54] SAFETY SKI BINDING

[75] Inventors: Josef Svoboda, Schwechat; Franz K. Edinger, Vienna, both of Austria

[73] Assignee: TMC Corporation, Baar, Switzerland

[21] Appl. No.: 251,038

[22] Filed: Apr. 6, 1981

Related U.S. Application Data

[63] Continuation of Ser. No. 34,193, Apr. 27, 1979, abandoned.

[30] Foreign Application Priority Data

Apr. 27, 1978 [AT] Austria ..... 3025/78

[51] Int. Cl.[3] ..... A63C 9/08

[52] U.S. Cl. ..... 280/634; 280/625

[58] Field of Search ..... 280/634, 625, 626, 628, 280/629, 630, 631, 632, 623, 611

[56] References Cited

U.S. PATENT DOCUMENTS

| | | | |
|---|---|---|---|
| 3,888,498 | 6/1975 | Gertsch et al. | 280/634 |
| 3,893,684 | 7/1975 | Schweizer | 280/634 |
| 3,893,685 | 7/1975 | Svoboda | 280/634 |
| 4,088,343 | 5/1978 | Krob | 280/625 |

FOREIGN PATENT DOCUMENTS

| | | | |
|---|---|---|---|
| 1578861 | 2/1971 | Fed. Rep. of Germany . | |
| 2415957 | 10/1975 | Fed. Rep. of Germany | 280/628 |

*Primary Examiner*—Joseph F. Peters, Jr.
*Assistant Examiner*—Milton L. Smith
*Attorney, Agent, or Firm*—Flynn, Thiel, Boutell & Tanis

[57] ABSTRACT

A safety ski binding having a pair of sole holders pivotally secured to a base plate. Structure is provided for damping the movement of the sole holders to the ski boot releasing position. The damping mechanism includes a chamber having a fluid therein and a member movable in the chamber. The movable member in the chamber is connected through linkage to the sole holders and moves in response to a movement of the sole holders. The fluid on one side of the movable member will flow in a restricted manner to the other side thereof in response to sudden movements of the sole holders. The initial movement of the movable member is, therefore, restricted due to the fact that the fluid on the aforesaid one side of the movable member is restricted in its flow to the other side. Upon the movable member reaching a critical point in the chamber, fluid will then be permitted to pass through a bypass opening to facilitate an unrestricted flow of fluid around the movable member thereby permitting the sole holders to move in an unrestricted manner to the released condition thereof.

26 Claims, 19 Drawing Figures

Fig. 11
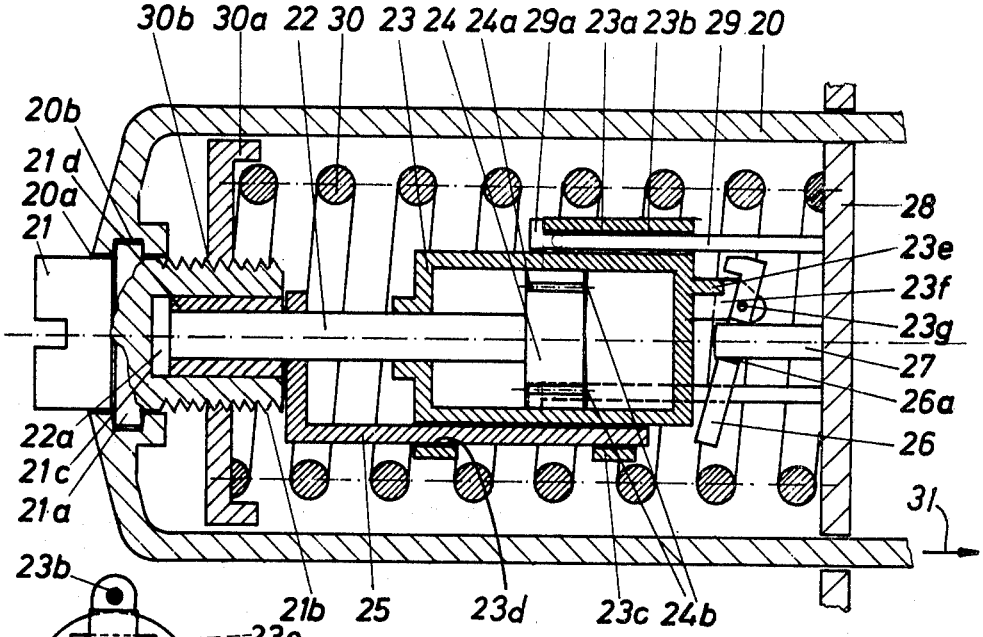
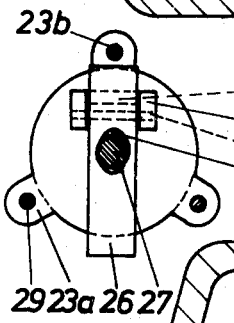
Fig.12a
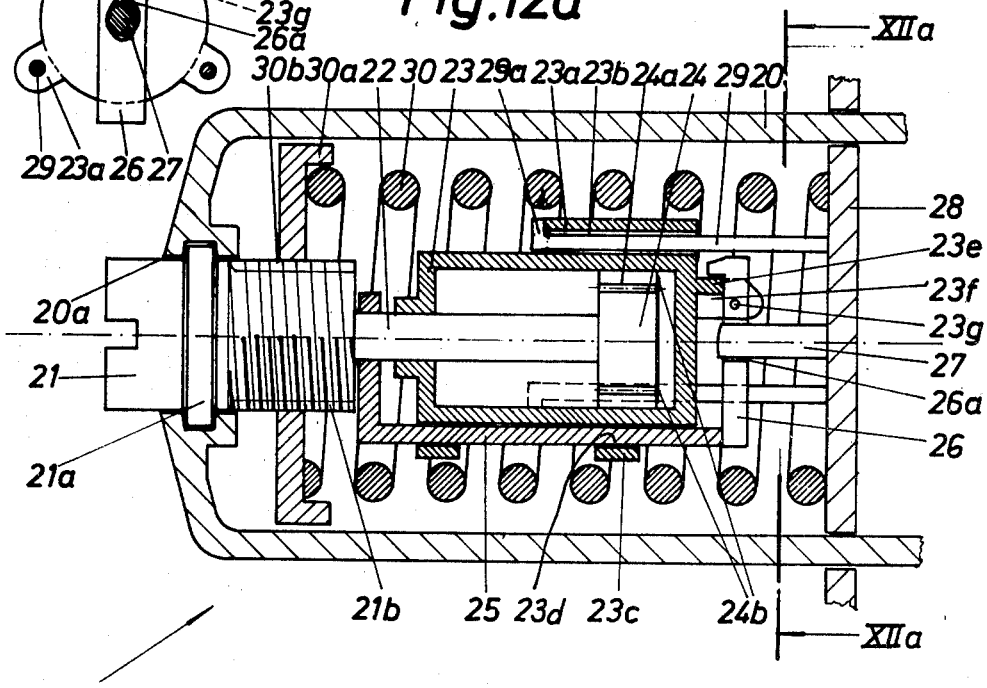
Fig.12

SAFETY SKI BINDING

This is a continuation, of application Ser. No. 34 193, filed Apr. 27, 1979, now abandoned.

FIELD OF THE INVENTION

The invention relates to a safety ski binding, in particular a front jaw, which releases upon reaching a predetermined force and releases the inserted ski boot, comprising at least one sole holder associated with a slide member which can be moved against the force of a spring, which slide member can be moved simultaneously against the resistance of a medium which is provided in a cavity of a binding-fixed structural part, which is for example secured on a base plate, and which cavity can be divided into two chambers by a member which can be moved in a binding-fixed structural part, wherein preferably and at least one opening is provided on the member for conducting the medium from the first chamber into the second chamber and back.

BACKGROUND OF THE INVENTION

A ski binding of this type is described generally in Austrian Pat. No. 320 493. The known construction describes a liquid, which is pressed by a piston into a further cylinder, in which an opposed piston is provided and is moved against a spring force. The forced arrangement of two cylinders, which are connected in series in the direction of the force and the piston is associated automatically with a larger material and work input, than if only one cylinder with one piston is provided. Even if such a solution is already known from German OS No. 1 578 901, in which the fluid is removed through a throttle opening which is constructed in the form of a hole, both solutions have the disadvantage that with the change of the compression of the medium, the release values of the ski binding also change. In other words: the change of the initial tension of the spring force brings about automatically a change of the release moment or of the release forces, wherein also the course of the release operation changes in relation to the adjusted strength of the release spring and the force of the entire damping system (cylinder, piston and throttle openings), which force depends on the release spring.

The purpose of the invention is now to provide a device of the above-mentioned type which will maintain the release value, at which the binding opens independently of the occurring impact forces, inventively constant.

The set purpose is inventively attained by the release value, at which the ski binding is released, being constant independently of the occurring impact forces, and by said value being determined by an enlarging or decreasing chamber which is provided in the binding-fixed structural part and which changes the cross section of the chamber, the limit of which enlarging or decreasing chamber is determined, viewed in the direction of movement of the member, by a snap-off edge on the inside wall of the binding-fixed structural part.

Due to the fact that in the binding-fixed structural part there is determined an exact point, upon the reaching of which the sole holders, which are loaded by the entire spring system—spring and damping device included—are released instantly, the set goal is satisfactorily attained for an exact value and in a simple manner. The necessary increased expense is, compared with conventional devices having a cylinder, small and at any rate less than a construction having two binding-fixed structural parts.

A particular preferable embodiment of the invention consists in, as is actually known, the binding-fixed structural part being a cylinder and the movable member being a piston which can be moved in a longitudinal direction of the cylinder and has preferably two openings, wherein the line of intersection of the rear side of the piston with the snap-off edge determines the limit value of conducting of the medium from the first into the second chamber of the cylinder. The construction of the binding-fixed structural part as a cylinder and of the movable member as a piston, is undoubtedly a simple and inexpensive, actually known solution. Due to the fact that inventively through the line of intersection of the rear side of the piston with the snap-off edge, the limit value for conducting of the medium from the first into the second chamber of the cylinder can be determined, the designer of such a binding receives with respect to determining the release value, both a clear teaching for the technical subject and also the possibility of determining with sufficient play these release values.

A preferable embodiment of the invention inventively consists of a substantially rectangular pressure plate of a uniform thickness being secured at the end of a piston rod which is associated in a conventional manner with the piston, said end being remote from said piston, which pressure plate extends transversely with respect to the longitudinal direction of the ski and also including a slide member and an adjusting screw which is associated with a spring, wherein the other end of the spring is supported on a support plate, which also closes off the front end of the cylinder, so that the spring and cylinder are arranged substantially parallel to one another and also parallel with respect to the longitudinal extent of the slide member.

A different embodiment of the invention is characterized by the snap-off edge and thus the intake opening of a bypass channel lying in the rest position of the piston approximately in the area of its front side or of the closed end of the cylinder. Thus, the start of the snapping-off feature can be determined.

A further inventive construction consists in the cross section of the bypass channel being constant starting with the snap-off edge or increasing continuously or having a form consisting of three sections one after the other, the first being a decreasing depth, the second being of a constant depth and the third being of a continuously enlarging depth, wherein on the two limits of the constant section and the adjoining two further sections, the cross section of which changes, there is provided an additional snap-off edge. The damping action can be controlled by this measure. Therefore, one can achieve that the damping action is reduced continuously with an increasing stroke, or that the course of the damping action changes in relation to the stroke.

A still further inventive construction consists in the slide member being constructed as a cylinder, which, but for an opening on its front side for receiving the adjusting screw, is closed and is closed off on its side, which is remote from said front side, by means of a binding-fixed support plate. The plate has supported thereon one end of a spiral spring, by the other end of which a support plate is loaded, wherein coaxially with respect to the longitudinal axis of the slide member the cylinder with the piston is arranged and the spiral spring surrounds the cylinder at a distance therefrom. The piston rod has at its end, which is remote from the piston, a retaining head which is held in a blind hole of the adjusting screw by means of a sleeve, which adjusting screw is rotatably supported through a conical flange or collar in a correspondingly shaped groove in the slide member, however nonmovably in the longitudinal direction of the slide member, and the support plate for the spring having a threaded hole therein, through which the initial tension of the spring can be adjusted by means of the thread on the adjusting screw received in the threaded hole. This construction will achieve a series connection of the spring and the damping device, without changing anything in the design of the basic principle of the damping device. At the same time, however, the advantage of a resilient arrangement which is connected in series is achieved.

A further development of this thought of the invention consists in securing on an outer surface and at approximately half the length of the cylinder, guideways which are offset at 120° and are each provided with one opening extending in the longitudinal direction of the binding, which guideways terminate flush with the closed end of the cylinder. Each opening has one guide pin which is secured to the support plate extending therethrough, which guide pin has at its ends, which are remote from the support plate, a stop which is engageable with the associated sides of the guideways and co-determine the expanding region of the spring. As a result, a simple arrangement is produced, by which the stroke of the spring system can easily be determined.

To fix the position of the cylinder in longitudinal direction of the ski, it is furthermore provided that the cylinder has a mounting member on the outside of its closed front side and arranged off-center with respect to its own longitudinal axis. The mounting member has arranged thereon a locking hook which is pivotal through a limited range about a mounting-fixed hinge pin and is constructed approximately hammer-shaped, and which locking hook has an oval opening which extends normally therethrough, the ovality of which extends in the longitudinal direction of the locking hook. A support pin which is secured to the support plate is received in the oval opening, the diameter of which pin corresponds approximately with the smallest distance between the edges of the oval opening.

A further inventive solution consists in the cylinder being lengthened beyond the end of the bypass channel, which end faces the support plate. The chamber which is formed by the extension is filled with a gaseous medium, preferably air, and the original cavity of the cylinder with the piston therein is filled with a liquid. The two chambers are separated from one another by a floating piston, and the floating piston is loaded if desired by a spring. The initial tension of the spring can be regulated preferably and in a conventional manner by means of an adjusting screw. Since the gaseous medium which acts against the floating piston is compressed along a polytrope by forces which are produced by the piston and by means of the liquid, the course of the release operation depends in addition on the position of the floating piston which in this manner is moved in direction toward the support plate. In the case of great impacts which last only a short time, only a small amount of liquid will flow through the openings, so that in such cases the floating piston is moved more strongly in a direction toward the support plate than if a sufficient amount of time is available for the liquid to flow from the chamber in front of the piston into the chamber behind the piston. If the piston reaches the snap-off edge, here too the damping function which is applied by the liquid onto the sole holders suddenly stops.

A different inventive embodiment consists in the binding-fixed structural part being a damping housing which is self-contained and the movable member being a damping blade which is pivotal about a vertical axis. The inside of the damping housing is limited in one direction of its expansion by two curved surfaces, the curvature of which is determined by different radii which are drawn from the centerpoint of the axis, follow one another and have at least one step therebetween. In this arrangement, the use of a back-and-forth moving piston is not needed, so that forces which act in the longitudinal direction of the ski and which produce possible vibrations cannot be created. Since in this arrangement we deal with a swingable construction, the possible vibrations which are created by the swinging of the damping blade can be neglected with respect to the holding function of the binding.

A further development of this thought of the invention consists in a substantially cube-like bearing block being secured on the base plate in the region of the end thereof which is remote from the operating lever. The bearing block is located in the longitudinal direction of the ski outside of the damping housing traversely with respect to the longitudinal axis of the ski approximately on the longitudinal axis of the base plate. An adjusting screw engages the bearing block to determine the position of the damping blade relative to the damping housing. By changing the position, the stroke, according to which the resistance-free release of the sole holder is to occur, can be adjusted between predetermined limits.

A still further thought of the invention consists, in particular in this construction, of the damping blade having on the side which faces the cavity of the damping housing and in the area of its free end a substantially rectangular recess of uniform depth, with which communicates an opening which extends through the damping blade transversely with respect to the ski, and a small spring plate arranged in the recess, which spring plate closes off the end of the opening which terminates in the recess. The spring plate is preferably secured, for example, screwed to the bottom of the recess. This construction permits a simple and inexpensive construction of a check valve.

Further inventive characteristics, advantages and details of the invention will now be described more in detail with reference to the drawings illustrating several exemplary embodiments.

BRIEF DESCRIPTION OF THE DRAWINGS

Various exemplary embodiments of the invention are illustrated in the drawings, in which:

FIG. 11 is a cross-sectional view of an exemplary embodiment of a damper, in which the snap-off edge can be adjusted hydraulically and mechanically;

FIG. 12 is also a cross-sectional view of the damper according to FIG. 11, in a position adjacent the snap-off edge;

FIG. 12*a* is a top view of the locking mechanism for the embodiment according to FIGS. 11 and 12;

Figure 1:
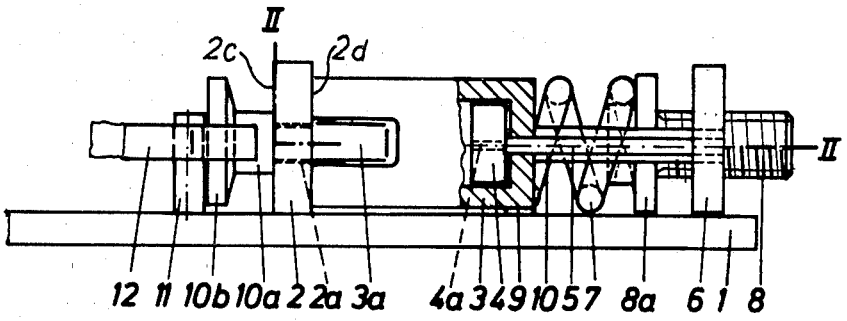
FIG. 1 is a front view of a front jaw with the inventive damper, partly in cross section.
Figure 2:
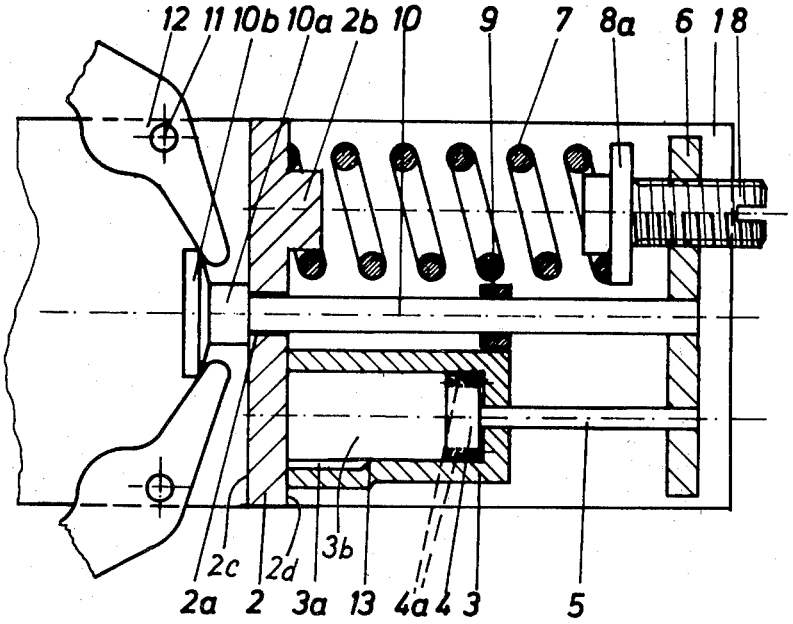
FIG. 2 is a cross-sectional view taken along the line II—II of FIG. 1.

The same structural parts in the individual exemplary embodiments are identified as much as possible, by the same reference numerals; however, structural parts which attain the same purpose but are designed differently, are identified by the same reference numeral having one or several primes (') as a suffix to facilitate differentiation.

DETAILED DESCRIPTION

In the first exemplary embodiment according to FIGS. 1 to 4, a substantially rectangularly elongated base plate 1 of uniform thickness has thereon a rectangular support plate 2 also of uniform thickness approximately equal to the thickness of the base plate 1. The support plate stands upright on the base 1 perpendicular to the longitudinal axis of the base plate and the upper side of the base plate. The central part of the support plate 2 has an opening 2*a* therethrough which extends perpendicular to the surface 2*c* on the support plate 2. As can be seen from FIGS. 1 and 2, the support plate has laterally of the opening 2*a* on one side thereof an elongated cylinder 3, the longitudinal axis of which extends perpendicular to the surface 2*c* and parallel with respect to the longitudinal axis of the base plate 1.

A bypass channel 3*a* is provided in the internal wall of the cylinder 3 and extends from a surface 2*d* on the front of the support plate 2 opposite the surface 2*c* and has a length approximately half as long as the length of the unoccupied part of a cylinder chamber 3*b* and a width which is half of its inside diameter. A piston 4 which has two holes 4*a* extending therethrough is provided inside of the cylinder chamber 3*b*. The unoccupied part of the cylinder chamber 3*b* is the part to the left of the piston 4 in FIG. 2. The piston 4 which is secured to a piston rod 5 is in the non-operated position thereof in the position according to FIG. 2. The length of the piston rod 5 corresponds with the length of the cylinder 3. The free end of the piston rod 5 is secured to a pressure plate 6, which will be described below in more detail. The cylinder chamber 3*b* is filled with a gas-liquid mixture.

On the other side of the support plate 2, which side is opposite the cylinder 3, there is supported a coil spring 7, the diameter of which corresponds substantially to the diameter of the cylinder 3. The spring 7 is held in position at one end with the aid of a cylindrical shoulder 2*b* formed on the surface 2*d* of the support plate 2. The other end of the coil spring 7 is supported on an end of an adjustable adjusting screw 8 defining a bearing bracket 8*a*. The axis of the adjusting screw extends perpendicularly to the pressure plate 6 having an internally threaded hole therein into which is screwed the adjusting screw 8.

The pressure plate 6 is a substantially rectangular plate of uniform thickness, the length of which is slightly shorter than the width of the base plate 1. In the nonoperated position of the binding, the pressure plate 6 is approximately in the region adjacent one end of the base plate 1. As can be seen from FIGS. 1 to 10, there is provided a guideway 9 in the region of the central longitudinal axis of the base plate 1 extending perpendicularly therefrom and terminating at the height of the cylinder 3. A pull rod 10, which is fixedly connected at one end thereof to the pressure plate 6, is guided through the guideway 9 and the opening 2*a* in the support plate 2. The other end of the pull rod 10 has a shoulder 10*a* thereon, which functions as a stop. The shoulder 10*a* transforms into a platelike art 10*b* at the end of the rod 10. Two toggle levers 12 engage the platelike part 10*b*, which toggle levers are pivotally supported on axles 11.

Upon operation of the pull rod 10 by the toggle levers 12, the pressure plate 6 is pulled in a direction toward the support plate 2. During this movement both the coil spring 7 is compressed and the piston 4 is urged by the piston rod 5 further into the cylinder 3. The gas-liquid mixture which is provided in the cylinder 3 will flow through the two holes 4*a* from the chamber 3*b* which becomes smaller into an enlarging chamber on the other side of the piston 4. The stronger and more forceful the operation of the mentioned structural parts on the pull rod 10, the stronger is the damping or resistance to movement by the piston 4 and the gas-liquid mixture in the cylinder which flows through the holes 4*a*.

Figure 3:
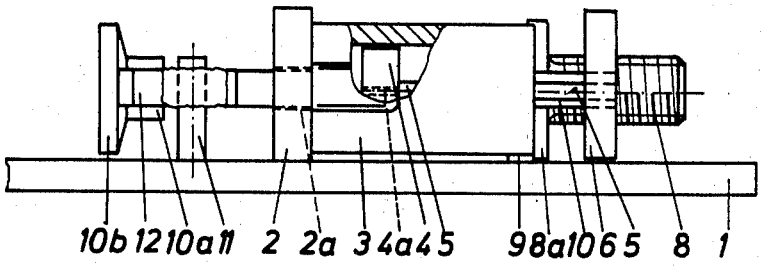
FIGS. 3 and 4 illustrate the front jaw according to FIGS. 1 and 2 in an operated condition, wherein the damping piston is positioned at the snap-off edge.
Figure 4:
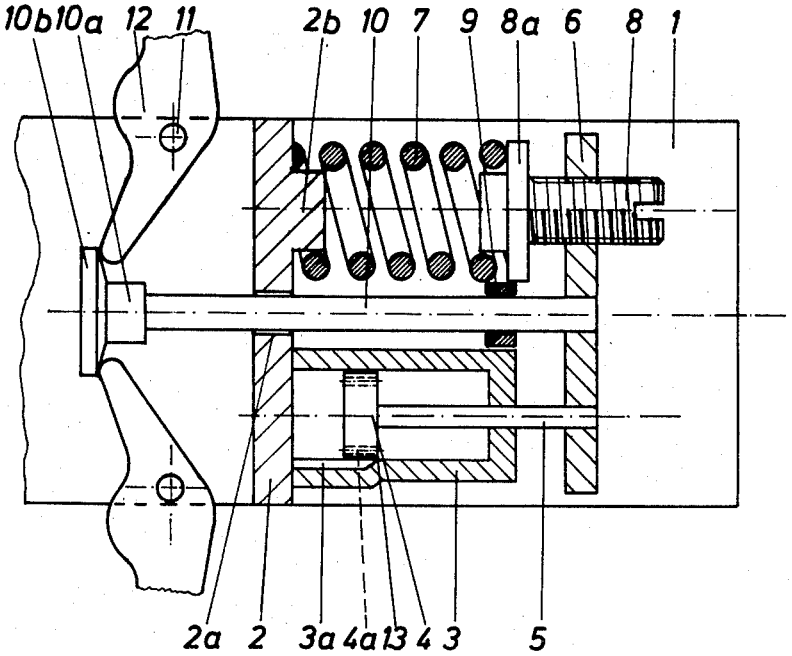
Figure 5:
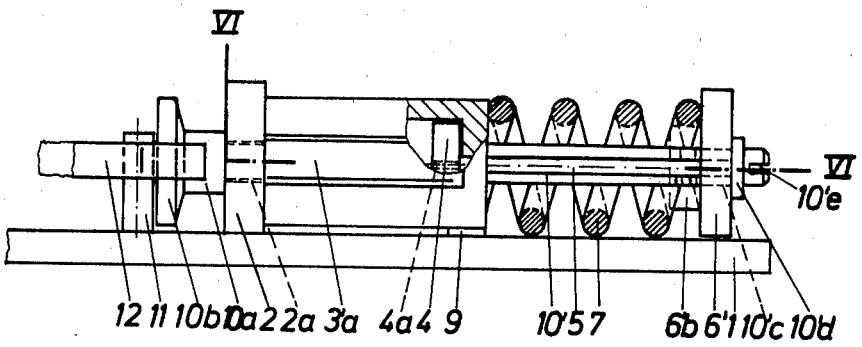
FIGS. 5 and 6 are a front and a top view, partly in cross section along the line VI—VI of FIG. 5 of an exemplary embodiment with a damper which becomes softer with a harder release-force adjusting and with an increasing operating stroke (lift)
Figure 6:
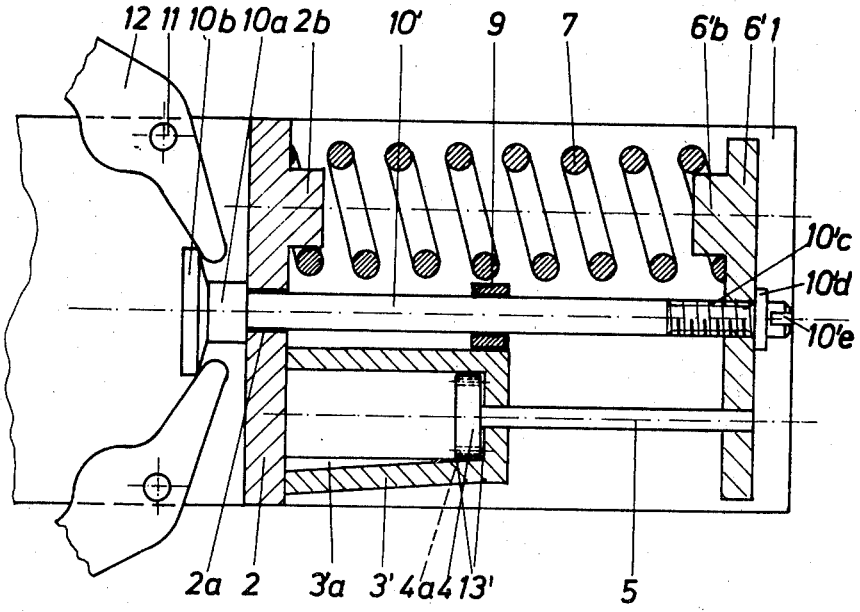

The damping or resistance to movement will continue to occur until the piston 4 arrives in the position as illustrated in FIGS. 3 and 4. The piston 4 rests in this position with its rear or right side in FIG. 4 on a so-called snap-off edge 13 in the wall of the cylinder 3. This edge is so named due to the fact that during a further movement of the piston 4 in a direction toward the support plate 2, the bypass channel 3*a* is freed and the gas-liquid mixture can flow relatively unrestricted into the enlarging chamber which is forming behind the piston 4. Thus, no damping at all takes place and the only force resisting further movement of the levers 12 and the pull rod 10 is the force applied by the coil spring 7.

In the case of a tighter binding adjustment, which is achieved by adjusting the adjusting screw 8 to increase the initial tension of the coil spring 7, the location of the snap-off edge remains the same. The resistance force which is applied by the damper is thus independent of the binding adjustment.

The exemplary embodiment which is illustrated in FIGS. 5 to 8 is substantially similar to the one illustrated in FIGS. 1 to 4. The pull rod 10' has a thread 10'*c* in the area of the end adjacent the pressure plate 6. The pull rod 10' is threadedly secured to the pressure plate 6' by the thread 10'c. In order to prevent a loss of the pressure plate 6', the pull rod 10' has a radially outwardly extending shoulder 10'd thereon. Furthermore the pull rod 10' has a slot 10'e therein at the aforementioned end, which slot serves to receive a screwdriver or a coin for adjustment purposes.

The pressure plate 6' has approximately in its center an internally threaded hole 6'a. In the region of the coil spring 7 there is provided on the pressure plate 6' a cylindrical shoulder 6'b which serves to guide the coil spring 7, which shoulder 6'b corresponds substantially with the cylindrical shoulder 2b in the support plate 2 in FIGS. 1 to 4.

The cylinder 3' has approximately at the same location as in FIGS. 1 to 4 a bypass channel 3'a, the intake opening and thus the snap-off edge 13' of which, viewed in the direction of movement of the piston 4, lies in the rest position approximately in the region of the front or left side of the piston 4 when it is at its rightmost position or the closed end of the cylinder, so that the bypass channel 3'a extends over the entire length of the cylinder 3' and continuously enlarges in depth in a direction toward the support plate 2.

The operation of the binding mechanism occurs substantially in the same manner as in the first exemplary embodiment according to FIGS. 1 to 4. The pull rod 10' is operated through the toggle levers 12 such that the pressure plate 6' is moved in a direction toward the support plate 2. As a result, both the coil spring 7 is compressed, and the piston 4 is moved in the cylinder 3' in a direction toward the support plate 2. The gas-liquid mixture which is in front of the piston 4 flows in a restricted manner through the two holes 4a in the piston 4 and through the bypass channel 3'a, which enlarges with the increasing piston stroke, into the enlarging chamber which is forming on the opposite side of the piston 4.

It is achieved through the provision of the inventive construction of the bypass channel 3'a that the damping action is continuously reduced with an increasing stroke.

Figure 7:
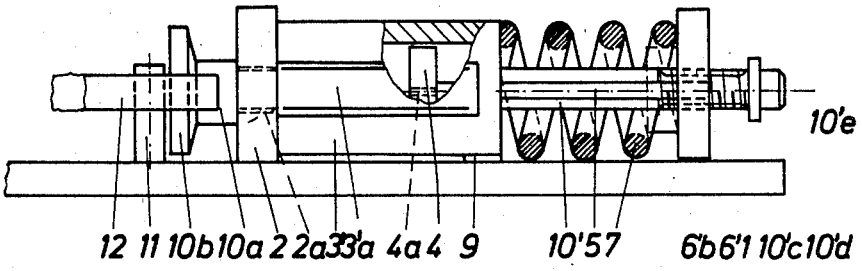
FIGS. 7 and 8 are also associated views of the front jaw according to FIGS. 5 and 6 in a shifted position.
Figure 8:
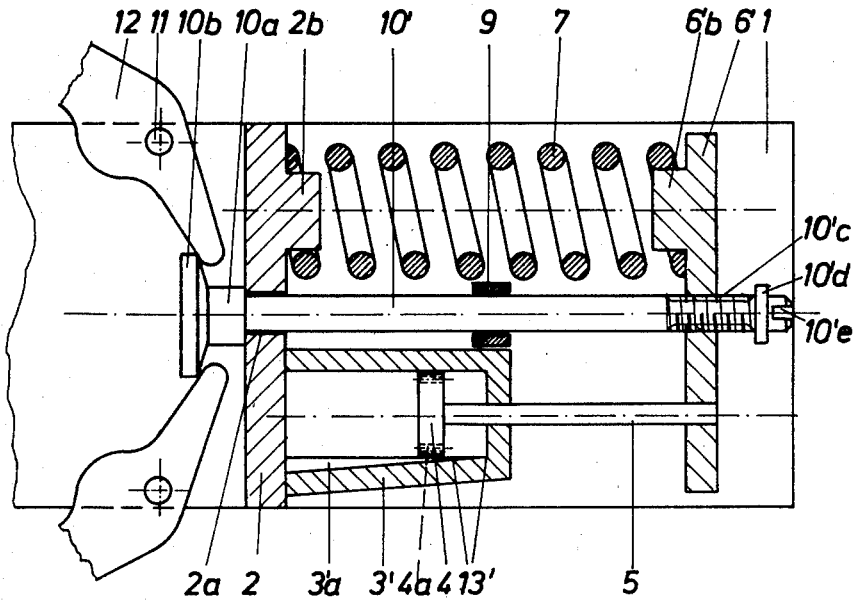

In the case of a tighter binding adjustment, caused by a stronger initial tension of the coil spring 7, which occurs by turning the pull rod 10' to cause the pressure plate 6' to move in a direction toward the support plate 2, the piston 4 is moved to the same degree as the pressure plate 6' toward the support plate 2 (see FIGS. 7 and 8). As a result of this movement, the piston 4 will lie in the cylinder 3' in the region where the bypass channel 3'a is already wider. As a result, during a movement of the piston 4 toward the support plate 2, a considerable amount of the gas-liquid mixture will flow through the bypass channel 3'a into the second and enlarging chamber which is forming behind the piston 4.

Thus the damping action of the binding becomes weaker with a tighter binding adjustment and with an increasing damping stroke. A weak binding adjustment will initiate a stronger damping action, since in such a case the action of the bypass channel 3'a gradually becomes unrestrictive to the flow of the gas-liquid mixture therethrough.

Figure 9:
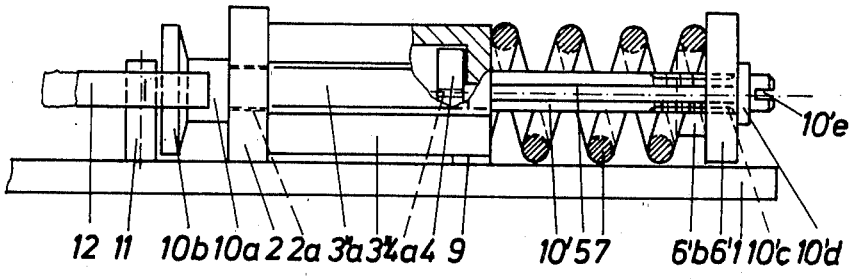
FIGS. 9 and 10 illustrate a further exemplary embodiment, in which with a tighter or stiffer release-force adjustment and with an increased operating stroke, the damper has a soft-constant-hard operating sequence, otherwise similar to FIGS. 5 and 6.
Figure 10:
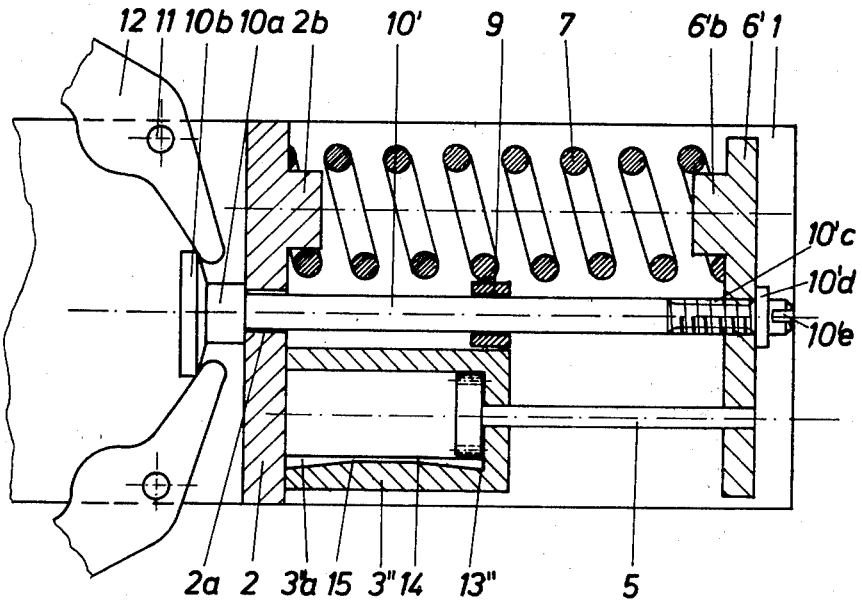

The exemplary embodiment which is illustrated in FIGS. 9 and 10 is designed, except for the bypass channel 3''a in the cylinder 3'', the same as in the exemplary embodiment according to FIGS. 5 to 8. The bypass channel 3''a has in its first third portion, starting from the end remote from the support plate 2, a continuously decreasing depth, which in its second third portion transfers into a parallel section and in its last third portion into a continuously enlarging depth. Through this type of construction of the bypass channel 3''a, it is achieved that the binding initially dampens relatively weakly with the damping action increasing up to a high value, holding this high value until the end of the parallel section of the bypass channel, and then becomes continuously softer. Thus a tighter binding adjustment assures that the binding does not dampen too softly at the start of a release operation and in the first third portion of the stroke. Therefore, three snap-off edges 13'', 14 and 15 exist.

In the exemplary embodiment illustrated in FIGS. 11, 12 and 12a, the snap-off edge is controlled in a hydraulic-mechanical manner. We deal substantially with a hollow cylindrical slide member 20 which, as can be seen from the drawing, is closed at one front or left end except for one opening 20a, which is required to receive an adjusting screw 21 therein. The adjusting screw 21 has a radially outwardly extending conical bead 21a or collar which is received in a correspondingly shaped groove 20b in the slide 20. The wall thickness of the slide 20 adjacent the groove 20b is designed approximately twice as thick as in the remaining part.

Starting from the end which is remote from the slotted head, the adjusting screw 21 has at approximately its midpoint a thread 21b . Furthermore, the adjusting screw 21 has, starting from the same end as the thread 21b, also extending to approximately its longitudinal midpoint, a concentric blind hole 21c. The blind hole 21c receives a retaining head 22a of a cylindrical piston rod 22 therein, the diameter of which is substantially slightly smaller than the diameter of the blind hole 21c. The other end of the piston rod 22 is connected to a piston 24 which is longitudinally movable in a cylinder 23 which is filled with a gas-liquid mixture. The piston 24 has two restriction orifices 24a, the axes of which are arranged parallel to the axis of the piston rod 22. Check valves 24b are provided on the side of the piston remote from the piston rod 22. The check valves 24b are constructed as flaps. The retaining head 22a of the piston rod 22 is held by a sleeve 21d in the blind hole 21c against a force which acts in longitudinal direction of the piston rod 22. The sleeve 21d can be arranged with a press or forced fit in the blind hole 21 or can be threaded therein.

The cylinder 23 has, as can best be recognized with reference to FIG. 12, three guideways 23a on its periphery which are each offset at 120° and provided with an opening 23b extending in a longitudinal direction parallel to the axis of the rod 22. The guideways 23a are rigidly connected to the cylinder 23 and are constructed approximately half the length thereof. The guideways terminate flush with the end of the cylinder 23, which end is remote from the adjusting screw 21.

Two plates 23c are arranged on the outside of the cylinder 23 and are rigidly connected thereto, as can be seen from FIGS. 11 and 12. With the aid of the two plates 23c, each of which also has one opening 23d therein which extends parallel with respect to the longitudinal axis of the cylinder, one leg of a release bar 25 which is substantially L-shaped in the top view (in cross section) is guided in the openings 23d contained therein. The other leg of the release bar 25 is rigidly connected to the piston rod 22 immediately adjacent the adjusting screw 21.

A stop 23*e* and a mounting member 23*f* are arranged on the outside of the cylinder 23 and at an end thereof remote from the adjusting screw 21 and are constructed preferably of the material of the cylinder 23. Both the stop 23*e* and the mounting member 23*f* are arranged off-center with respect to the longitudinal axis of the cylinder 23. A locking hook 26 which is approximately hammer-shaped in construction, is pivotally supported through a limited range on the mounting member 23*f* about the axis of a hinge pin 23*g*. Approximately in the region of the center of the locking hook 26 there is provided an oval opening 26*a* which extends through the locking hook. A support pin 27, the diameter of which is dimensioned such that it corresponds approximately with the smallest spacing between the edges of the oval opening 26*a*, projects into and through the oval opening 26*a*. A type of a two-point contact is achieved therewith between the support pin 27 and the oval opening 26*a*, as can be seen from FIG. 12*a*.

The support pin 27 is secured approximately in the center of a binding-fixed support plate 28 which closes off the open end of the slide member 20 and which is perpendicularly aligned with respect to the longitudinal axis of the slide member 20. The slide member 20 extends through the support plate 28 with little clearance. The support plate 28 has three guide pins 29 each of which extends perpendicularly away from the support plate and through one of the openings 23*b* in the guideways 23*a*. The guide pins 29 have stops 29*a* at their free ends which face toward the open end or right end of the cylinder 23. The stops determine the largest possible tension region (relaxation) of a spring 30 which extends between the plate 28 and a further plate 30*a*. The plate 30*a* is threadedly coupled to the screw 21.

During an operation of the inventive damping device the slide member 20 is pulled in direction of the arrow 31. The adjusting screw 21, piston rod 22 and piston 24 and all structural parts which are connected therewith also carry out this movement and substantially cover also the same path as the slide member 20. The cylinder 23 also carries out this movement until the support pin 27 which slides in the oval opening 26*a* of the locking hook 26 pivots the off-center supported locking hook 26 in such a manner that the edges of the oval opening 26*a* jam or lock on the support pin 27.

A further movement of the cylinder 23 in direction of the arrow 31 is now for a time prevented. The piston 24, however, is forced to partake through the piston rod 22 in the movement of the slide member 20. As a result, the pin 24 is moved to the right in the now fixed cylinder 23 and in direction of the arrow 31. During this movement, the gas which is in the cylinder 23 or the liquid therein causes the two check valves 24*b* to be pressed onto the orifices 24*a*. Thus a damping action is obtained which continues until the leg of the L-shaped release bar 25 which slides with the piston 24 and with the piston rod 22 in direction of the arrow 31, strikes the locking hook 26 and causes it to swing counterclockwise. Thus the edges of the oval opening 26*a* disengage from the support pin 27.

In order to prevent too great a pivoting of the locking hook 26 in the counterclockwise direction, which pivoting also effects a jamming of the oval opening 26*a* on the support pin 27, a stop 23*e* is provided in the mounting member 23*f* of the locking hook 26.

With the release of the locking hook 26, the cylinder 23 will again carry out a movement in the direction of the arrow 31. A damping action which existed up to now, caused by the medium in the cylinder 23 and the piston 24 which presses against it, now no longer exists. With the release of the locking hook 26, the snap-off edge is reached. Starting at this point, the damping which is applied by the coil spring 30 onto the slide member 20 now becomes active. If the force, which pulls the slide member 20 in the direction of the arrow 31, stops acting, the slide member is again pressed into the position according to FIG. 11 by the force of the relaxing coil spring 30, and all structural parts which are connected thereto. The cylinder 23 will also slide in a direction opposite to the arrow 31, namely until the guideways 23*a* engage the stops 29*a* of the guide pin 29. Starting at this point, the cylinder 23 is prevented from a further movement in the direction opposite the arrow 31, the piston, however, continues to slide in the cylinder 23 in the aforementioned opposite direction. The medium, which is in the cylinder 23, presses the check valves 24*b* open and facilitates a relatively unrestricted flowing bypass into the enlarging (second) chamber of the cylinder 23, which is remote from the piston rod 22. In the case of a tighter binding adjustment, the damping path which is available becomes smaller, namely the snap-off edge is reached earlier.

Figure 13:
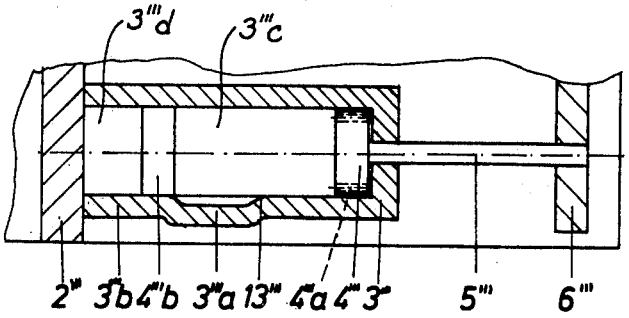
FIG. 13 is a cross-sectional view of a damper having a floating piston.

The damper which is illustrated in FIG. 13 is similar in design to the one illustrated in FIGS. 1 to 4. The cylinder 3''' is, however, extended beyond the end of the bypass channel 3'''*a*, which end is adjacent the support plate 2''', so that it—assuming the same dimensions for the cavity of the cylinder 3''', which cavity is provided with the piston 4'''—is longer in the length of the extension 3'''*b* than the cylinder 3. A further, so-called floating piston 4'''*b*, in the nonoperated position thereof in the position according to FIG. 13, is provided between the cavity formed by the extension 3'''*b* and the original cavity. The original cylinder chamber 3'''*c* is filled with liquid, the further cavity 3'''*d* is filled with a gaseous medium, preferably air.

Figure 14:
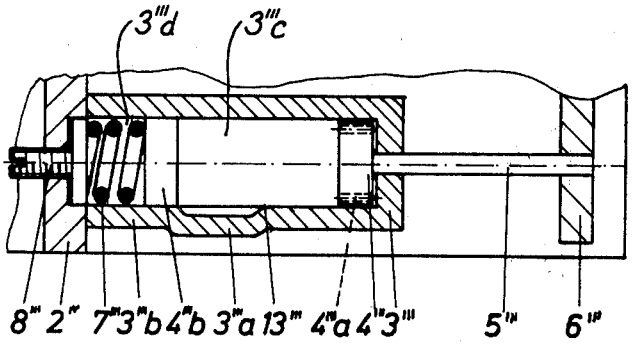
FIG. 14 illustrates a damper having a floating piston, coil spring and coil-spring adjustment mechanism.
Figure 15:
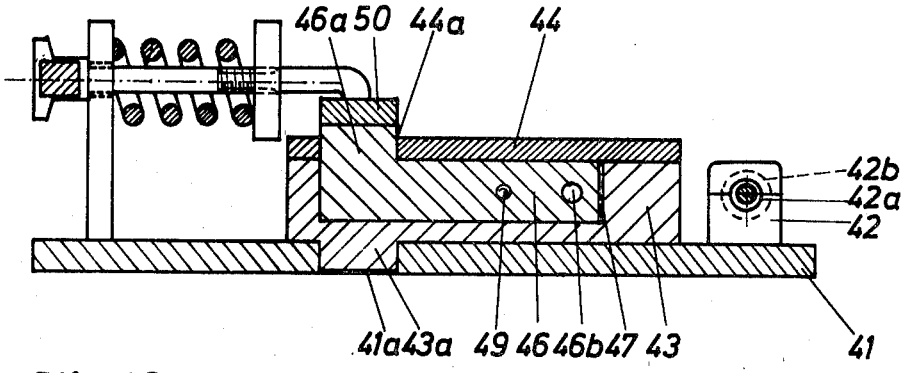
FIG. 15 is a cross-sectional view taken along the line XV—XV of FIG. 16 of an inventive damper having an adjustable snap-off edge.
Figure 16:
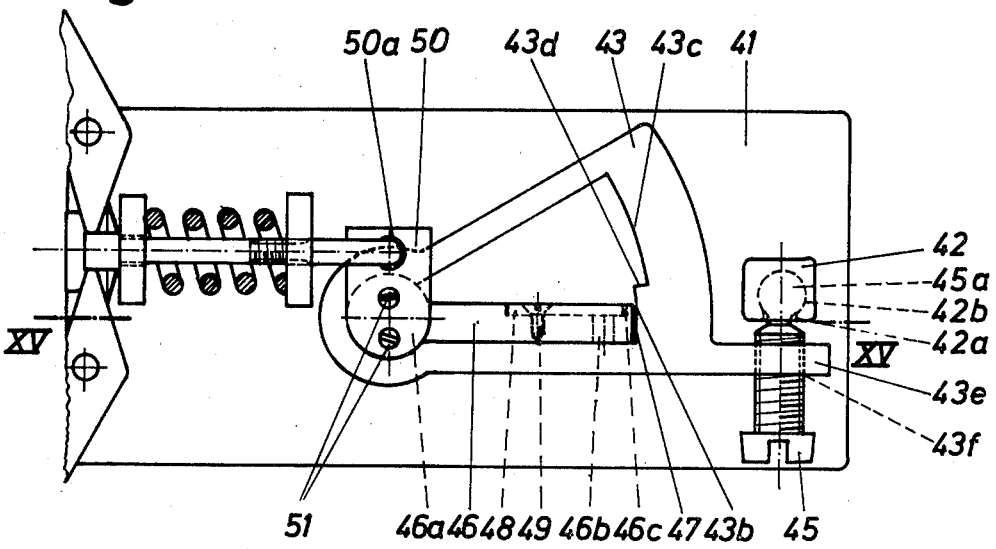
FIG. 16 is a top view of FIG. 15, however, the damping housing is without a lid.
Figure 17:
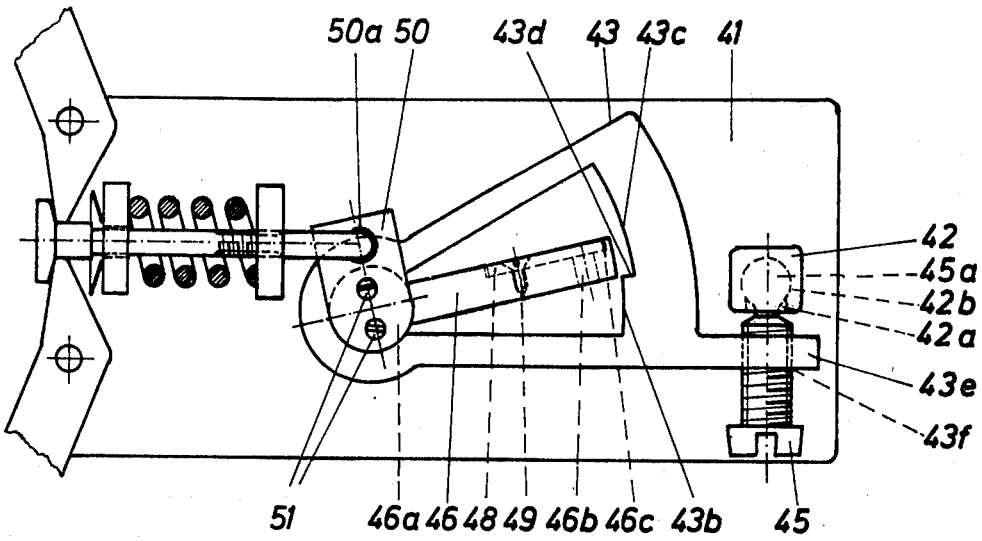
FIG. 17 is a top view like FIG. 16, wherein the damping wing is located at the snap-off edge.

FIG. 14 illustrates the damping device as in FIG. 13 with a coil spring 3'''*b* which biases the floating piston 4'''*b* in a direction toward the pressure plate 6 and an adjusting screw 3'''*c* which facilitates an adjustment of the initial tension of the coil spring 3'''*b*. The filling of the two chambers corresponds with the one of FIG. 13.

The two previously described damping cylinders with their operating and adjusting devices can also be used in place of the cylinders which are illustrated in FIGS. 1 to 12. If the piston 4''' is moved by the piston rod 5''' and the other structural parts which are necessary for the operation and are described more in detail in FIGS. 1 to 4 in the cylinder 3 in a direction toward the support plate 2''' or 2$^{IV}$, the floating piston 4'''*b*, loaded through the liquid, is also moved. However, the path covered by the floating piston 4'''*b* becomes smaller than the one of the piston 4''', since a portion of the liquid will flow through the through holes 4'''*a* into the enlarging cylinder chamber.

The stronger and faster the piston 4''' is pushed into the cylinder 3''', the less fluid can flow through the holes 4'''*a* and the more is the floating piston 4'''*b* moved in a direction toward the support plate 2'''. The gaseous medium is thereby condensed along a polytrope. In FIG. 14, the coil spring 3'''*b* is in addition compressed. When the piston 4''' has reached the snap-off edge 13''' (bypass channel 3'''*a*), suddenly any damping applied by the liquid onto the sole plate stops.

The ski binding with a hydraulic damper according to FIGS. 15 to 18 has a conventional arrangement of a spring rod with a limit stop, spring, resilient sleeve and rocking lever. Since the arrangement of these structural parts which are necessary for the operation of the damper does not form the subject matter of the invention, it is also not described in any further detail.

A substantially rectangularly shaped base plate 41 of uniform thickness has approximately in its center an opening 41*a* which extends vertically therethrough. The base plate 41 supports in the area of the end which is remote from the operating device and approximately on its longitudinal axis a bearing block 42 which is fixedly connected thereto and is substantially cube-shaped. The bearing block 42 has on a side thereof which is vertical with respect to the base plate 41 an opening 42*a*, the axis of which is substantially parallel with respect to the upper side of the base plate 41. The opening 42*a* transfers inside of the bearing block 42 into an approximately spherical recess 42*b*.

Furthermore the base plate 41 has a damping housing 43. A pin 43*a* projects from the underside of the damping housing 43 and is received in the opening 41*a* of the base plate 41. The entire damping housing 43 is pivotally supported about the axis of the pin 43*a*. The upper side of the damping housing 43, which is open in an upward direction, is covered by a cover plate 44, which has in the area above the pin 43*a* an opening 44*a*, therethrough, the diameter of which is approximately of the same size as the diameter of the opening 41*a* in the base plate 41.

The damping housing 43 which extends in a direction toward the bearing block 42 and which enlarges approximately V-shaped with an increasing distance from the center axis of the pin 43*a* is defined on its inside by two surfaces 43*b*, 43*c* with different radii, which surfaces are curved concentrically with respect to the central axis of the pin 43*a*.

The first concentrically curved surface 43*b* starts at the sidewall of the damping housing 43 which is associated with the bearing block 42 and is not identified in detail. It is designed approximately half as long as the second surface 43*c* which follows with a step surface 43*d* and is formed with a greater radius. A shoulder or flange 43*e* follows as an extension of the sidewall of the damping housing 43, which sidewall faces the bearing block 42. A threaded hole 43*f*, which is parallel with respect to the base plate, extends perpendicularly through the shoulder or flange 43*e*, approximately in its center.

A screw 45 is threadedly received in the hole 43*f*, which screw has at one end a spherical construction 45*a* received and supported in the spherical recess 42*b* of the bearing block 42. The bearing block 42 is designed in two parts for the purpose of receiving the spherical construction 45*a* of the screw 45. The other end of the screw 45 is provided with a slotted head for receiving a tool which is not separately identified.

All parts described so far are arranged in such a manner on the base plate 41 that they do not project therebeyond. A damping blade having a substantially rectangular cross section is provided within the damping housing 43. In the area of the pin 43*a* of the damping housing 43 the damping blade 46 passes over from its rectangular cross section into a cylindrical part 46*a*. The cylindrical part 46*a* has the same diameter as the pin 43*a*. The center axis of the pin 43*a* and the center axis of the cylindrical part 46*a* are in axial alignment.

The cylindrical part 46*a* of the damping blade 46 extends through the opening 44*a* of the cover plate 44 and projects therebeyond a small distance. The edge which is remote from the cylindrical part 46*a* of the damping blade 46 has also a curvature which is concentric with respect to its axis of rotation. The damping blade 46 is, however, limited in length so that between it and the first concentrically curved surface 43*b* there remains a free gap 47. In the area of the curved end of the damping blade 46, an opening 46*b* extends perpendicularly to the length of the damping blade and parallel with respect to the base plate 41 and through the damping blade. The side of the damping blade 46, which side faces the second concentrically curved surface 43*c*, has a substantially rectangular recess 46*c* of uniform depth. The rectangular recess 46*c* is arranged such that it is in the region of the opening 46*b*.

A small spring-steel plate 48 is provided in the rectangular recess 46*c*, which plate is only a little smaller than the rectangular recess 46*c*. A counter-sunk screw 49, which is provided at the end of the small spring-steel plate, which end is associated with the cylindrical part 46*a*, connects same to the damping blade 46.

An operating lever 50 is secured to the cylindrical part 46*a* of the damping blade 46, which part projects beyond the damping housing 43 by means of two counter-sunk screws 51. One end of the operating lever 50, which is provided above the cylindrical part 46*a*, terminates flush with the sidewall of part 43. The operating lever 50 projects in the position according to FIG. 16 over the damping housing 43 in a direction toward the side of the base plate 41 and substantially parallel with respect to the axis of the screw 49. The projecting end of the operating lever 50 is designed substantially rectangular. Furthermore the operating lever 50 has in the area of the last-mentioned end on its central longitudinal axis an opening 50*a* which extends perpendicularly therethrough.

If now the damping blade 46, which rests (FIG. 16) or almost rests (FIG. 18) in the normal position or in the nonoperated position on the sidewall of the damping housing 43, which sidewall is associated with the bearing block 42, (depending on the position of the adjustable damping housing 43, which position will be described still in more detail) is loaded through the operating lever 50 in a counterclockwise direction, it will attempt to compress the liquid which is provided inside of the damping housing 43. Since this, however, is not possible, the liquid flows through the gap 47 from the chamber which becomes smaller into the enlarging chamber of the damping housing 43 created during this movement of swing.

The stronger the operation, the stronger is the damping force which the liquid applies to the damping blade 46, because the liquid cannot flow so quickly through the narrow gap 47, as is required by the vigor of the operation. The liquid applies a damping action onto the damping blade 46 until the damping blade 46 reaches with its outer edge the shoulder or step 46*d*, which corresponds at the same time with the snap-off edge. At this point the liquid will move promptly from the chamber which is becoming smaller into the enlarging chamber. Thus, also any damping action stops promptly.

However, if we deal with a regular operation of the damping blade 46, then the liquid flows continuously through the gap 47. Therefore, the damping is not as strong. Just as in the aforedescribed case, any damping action stops here too at the location of the gradation or step 43*d* functioning as the snap-off edge. If the force which acts in counterclockwise direction on the operating lever 50 is discontinued, then the damping blade 46 is swung by the spring-loaded operating lever 50 clockwise into the initial position. A large portion of the liquid flows through the gap which exists between the damping blade 46 and the second concentrically curved surface 43*c* into the enlarging chamber. Furthermore the liquid which flows through the opening 46*b* presses on the small spring-steel plate 48 which functions as a check valve. Prior to reaching the gradation or step 43*d* which functions as a snap-off edge, the large portion of the liquid flows through the gap 47 which exists between the second concentrically curved surface 43*c* and the damping blade 46 and after reaching the snap-off edge exclusively into the opening 46*b*.

Figure 18:
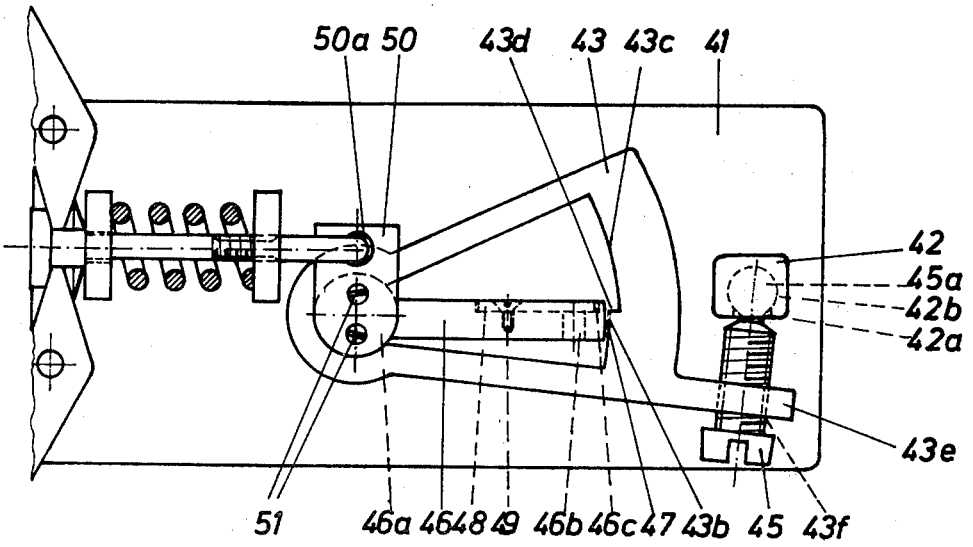
FIG. 18 is a top view like FIG. 16, however, having a damping housing swung in a clockwise direction.

The damping housing 43 is swung in FIG. 18 by means of the screw 45 in a clockwise direction. Since the damping blade 46 cannot partake in this swinging movement, the position of the snap-off edge is thus adjusted, namely the liquid can already earlier flow relatively unrestricted. Thus, the damper is adjusted softer, namely the snapping-off will occur earlier.

The invention is not limited to the illustrated exemplary embodiments. Various modifications can be made without departing from the scope of the invention. In particular combinations of the individual embodiments can be made among one another, in order to achieve the most favorable damping action in each case. Also the construction of the binding, on which the damper is being utilized, is of no importance with respect to the scope of protection, if the sole holder acts against a spring-loaded slide.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A safety ski binding which releases upon reaching a predetermined threshold a ski boot therefrom, comprising:

a base plate adapted to be secured to a ski;

a sole holder movably mounted on said base plate and adapted to engage said ski boot, said sole holder being movable between a ski boot holding position and a ski boot releasing position;

resilient means operatively connected to and biasing said sole holder toward said ski boot holding position and resisting movement of said sole holder toward said ski boot releasing position;

dashpot means independent of said resilient means and operatively connected to said sole holder means and said resilient means for further resisting the movement of said sole holder means from said ski boot holding position toward said ski boot releasing position, said dashpot means including first means defining a chamber and a member movable in said chamber and dividing said chamber into two parts, a fluid in said chamber, connecting means for connecting said sole holder means to one of said chamber defining first means and said movable member so that said movable member is moved relative to said chamber in response to a movement of said sole holder means, restricted passageway means extending through said movable member to provide a restricted fluid connection between said two parts of said chamber and to facilitate a transfer of said fluid from one part of said chamber to the other part thereof; and second means responsive to the position of said movable member in said chamber for suddenly reducing the resistance to movement of said movable member relative to said chamber and, consequently, the movement of said sole holder means to thereby facilitate the fast release of said ski boot from said ski binding.

2. The safety ski binding according to claim 1, wherein said chamber defining first means is a binding-fixed cylinder and said movable member is a piston which can be moved in a longitudinal direction along the length of said cylinder, and wherein said second means comprises an elongated segment of enlarged cross-sectional area in said cylinder, the region between the area of normal cross-sectional area and said enlarged cross-sectional area defining a snap-off edge means for determining the location of said piston at which the resistance to piston movement is suddenly reduced.

3. The safety ski binding according to claim 2, wherein said elongated segment defines a bypass channel, which channel is approximately half as long as the length dimension of said cylinder and half as wide as its inside diameter.

4. The safety ski binding according to claim 3, wherein said connecting means includes a piston rod secured to said piston and a pressure plate of a uniform thickness, which is substantially rectangular and is secured to one end of said piston rod, which end is remote from said piston, the plane of said pressure plate extending transversely with respect to the longitudinal axis of said ski, wherein said resilient means is a spring, said pressure plate having an adjusting screw thereon which is associated with one end of said spring, wherein the other end of said spring is supported on a support plate, which also closes off one end of said cylinder, so that said spring and said cylinder are arranged substantially parallel to one another and also parallel with respect to said longitudinal axis of said ski.

5. The safety ski binding according to claim 4, wherein the end of the bypass channel, which end is remote from said snap-off edge means, is at the end of said cylinder adjacent said support plate.

6. The safety ski binding according to claim 2, wherein the snap-off edge means and thus the opening of the bypass channel lies in the rest position of the piston approximately in the region of its front side or of the closed end of the cylinder.

7. The safety ski binding according to claim 2, wherein the cross-sectional size of said bypass channel, starting at said snap-off edge means increases uniformly along its length.

8. The safety ski binding according to claim 2, wherein said cylinder is extended beyond said snap-off edge means, the chamber in said cylinder being divided into two separate chambers by a floating piston, wherein the end of said chamber which is formed by said extension is filled with a gaseous medium and the end of the chamber at the other end is filled with liquid, said chamber at the other end having said first mentioned piston reciprocal therein, and wherein said floating piston is loaded by a spring, the initial tension of which can be regulated by means of an adjusting screw.

9. The safety ski binding according to claim 2, wherein the cross-sectional size of said bypass channel varies along the length thereof between a first segment of decreasing size, a second segment of uniform size and a third segment of increasing size, each of said segments being connected in series one after the other, the juncture between said first and second segments defining a further snap-off edge means.

10. The safety ski binding according to claim 1, wherein said connecting means includes an elongated push rod guided by means of a guideway, the axes of both of which extend parallel with respect to the longitudinal axis of said ski.

11. The safety ski binding according to claim 1, wherein said fluid is a gas-liquid mixture.

12. The safety ski binding according to claim 1, wherein said dashpot means includes a slide member constructed as a first cylinder, which is closed but for an opening at its one end for receiving an adjusting screw and is closed off at its other end by means of a binding-fixed support plate, wherein said resilient means includes a coil spring, one end of said coil spring resting on said support plate, an adjustable support plate threadedly coupled to said adjusting screw, the other end of said coil spring engaging said adjustable support plate, the tension of said coil spring being controlled by the relative position of said adjustable support plate on said adjusting screw, said dashpot means further including a second cylinder inside of said first cylinder and said coil spring and extending coaxially with respect to said first cylinder, said second cylinder having a piston rod, an end of which is retained in a blind hold in said adjusting screw, said adjusting screw being rotatably supported on said first cylinder and also supported nonmovably in a longitudinal direction relative to said first cylinder.

13. The safety ski binding according to claim 12, wherein guideways are secured to the outer surface and along approximately one half the length of said second cylinder, said guideways being offset at 120° and each provided with one opening in the longitudinal direction of said ski, said guideways terminating flush with the closed end of said second cylinder, wherein each opening has a guide pin therein secured to said binding-fixed support plate, said guide pins each being provided at their ends remote from said binding-fixed support plate with a stop resting on the associated sides of said guideways, said stops determining the magnitude of expansion of said coil spring.

14. The safety ski binding according to claim 12, wherein said second cylinder has a closed end and a mounting member which is arranged on the outside of said closed end and off-center with respect to the longitudinal axis of said second cylinder, a locking hook pivotally arranged through a limited range on a mounting-fixed hinge pin secured to said second cylinder, said locking hook having an L-shape with an oval opening extending normally through one leg thereof, the major axis of said oval opening extending in longitudinal direction of said one leg of said locking hook, and a support pin secured to said binding-fixed support plate and being received in said oval opening, the diameter of said support pin corresponding with the size of the minor axis of said oval opening.

15. The safety ski binding according to claim 14, wherein a stop is secured in the region of the path of swing of said locking hook and is fixedly arranged on said second cylinder.

16. The safety ski binding according to claim 14 or 15, wherein said mounting member and said stop are constructed out of the material of said second cylinder.

17. The safety ski binding according to claim 12, wherein said coil spring and said second cylinder which contains a hydraulic medium are stored inside of said first cylinder, are arranged in series with one another and can be regulated by means of said adjusting screw with respect to their initial tension.

18. The safety ski binding according to claim 1, wherein said dashpot means is a self-contained damping housing and said movable member is a damping blade with pivotal support means being provided for pivotally supporting said damping blade for movement about a vertical axis, wherein the inside of said damping housing is limited in one direction by an upright wall having two curved surfaces of differing radii and which follow one another with at least one step therebetween.

19. The safety ski binding according to claim 18, wherein the pivot axis of said damping blade is formed by a cylindrical hub part which extends through an opening in a cover plate which closes off said damping housing, said hub having an operating lever secured thereto, on which operating lever is engaged a resilient slide member, arranged eccentrically with respect to said pivot axis, said resilient slide member constituting a part of said connecting means providing an operative connection between said sole holder means and said damping blade.

20. The safety ski binding according to claim 19, wherein said damping housing has a downwardly extending bolt which projects into an opening in said base plate, which opening is arranged in axial alignment with said cylindrical hub part of said damping blade.

21. The safety ski binding according to claim 18, wherein between said damping blade and said upright wall of said damping housing having the smaller radius there is provided a gap.

22. The safety ski binding according to claim 18, wherein said step on said upright wall of said damping housing is said second means responsive to the position of said movable member.

23. The safety ski binding according to claim 18, wherein a bearing block is secured on said base plate in the region of said damping housing remote from said operating lever and in longitudinal direction of said ski and outside of said damping housing, said bearing block having engaged therewith an adjusting screw which determines the position of said damping blade relative to the damping housing, the axis of said adjusting screw extending transversely to the longitudinal axis of said ski.

24. The safety ski binding according to claim 23, wherein said bearing block has an approximately spherical recess therein, in which sits a correspondingly shaped spherical part on said adjusting screw, wherein the threaded part of said adjusting screws is received in a hole in a shoulder on said damping housing.

25. The safety ski binding according to claim 18, wherein said damping blade has on a surface thereof facing the cavity of said damping housing a substantially rectangular recess of uniform depth, with which communicates an opening which extends transversely with respect to the ski through said damping blade, and wherein a small spring plate is arranged in said recess and is secured to the bottom of said recess, which spring plate closes off the end of said opening terminating in said recess.

26. The safety ski binding according to claim 18, wherein the radius of the upright wall surface which follows the step and lies in direction of the inner chamber, increases continuously.

* * * * *